US005445514A

United States Patent [19]

Heitz

[11] Patent Number: 5,445,514

[45] Date of Patent: Aug. 29, 1995

[54] REFRACTORY MATERIAL COATED METAL SURFACES ADAPTED FOR CONTINUOUS MOLDING OF CONCRETE BLOCKS

[76] Inventor: Lance A. Heitz, 5461 Bay Shore Dr., Presque Isle, Mich. 49777

[21] Appl. No.: 124,698

[22] Filed: Sep. 22, 1993

[51] Int. Cl.[6] ..... B28B 1/08; B28B 7/36

[52] U.S. Cl. ..... 425/255; 249/114.1; 249/115; 425/452; 425/454; 425/456; 425/DIG. 55

[58] Field of Search ..... 249/112, 113, 114.1, 249/115, 116, 134, 135; 425/253, 255, 452, 456, 454, DIG. 53

[56] References Cited

U.S. PATENT DOCUMENTS

| | | | |
|---|---|---|---|
| 1,536,952 | 5/1925 | Udale et al. . | |
| 2,319,291 | 5/1943 | Besser . | |
| 2,566,787 | 9/1951 | Zevely . | |
| 2,587,413 | 2/1952 | Vander Heyden . | |
| 2,964,420 | 12/1960 | Poorman et al. . | |
| 2,985,935 | 5/1961 | Wellnitz . | |
| 3,419,415 | 12/1968 | Dittrich . | |
| 3,545,053 | 12/1970 | Besser . | |
| 3,588,028 | 6/1971 | Okamoto | 249/135 |
| 3,608,162 | 9/1971 | Staton . | |
| 3,660,004 | 5/1972 | Woelk . | |
| 3,832,119 | 8/1974 | Woelk . | |
| 3,848,847 | 11/1974 | Komatsu et al. | 249/115 |
| 4,235,580 | 11/1980 | Springs et al. . | |
| 4,260,352 | 4/1981 | Balhorn . | |
| 4,262,034 | 4/1981 | Andersen . | |
| 4,395,213 | 7/1983 | Springs et al. . | |
| 4,420,543 | 12/1983 | Kondo et al. . | |
| 4,571,983 | 2/1986 | Sanborn et al. . | |
| 4,919,388 | 4/1990 | Koike et al. | 249/115 |
| 4,978,488 | 12/1990 | Wallace . | |
| 5,069,937 | 12/1991 | Wall . | |
| 5,092,558 | 3/1992 | Katsuza | 249/135 |
| 5,202,156 | 4/1993 | Yamamoto et al. | 249/114.1 |

FOREIGN PATENT DOCUMENTS 2113235 of 0000 United Kingdom .

OTHER PUBLICATIONS

Product Engineering 59 to 64 (Dec. 6, 1965).

Metco Division of Perkin Elemer, Westbury, N.Y. pp. 2.1 to 3.2 with Tables 1 to 7.

*Primary Examiner*—Khanh P. Nguyen

*Attorney, Agent, or Firm*—Ian C. McLeod

[57] ABSTRACT

A concrete block molding apparatus and component molding parts coated with a flame spray refractory material and binder composition. The coatings can be smoothed to provide a finished surface for the blocks as by polishing, pressure on the coated surface or preferably by a coating of a thermoset resin as a binder. A preferred thermoset resin includes polytetrafluoroethylene (PTFE) in the coating to improve slipperiness. The parts have a greatly increased life cycle and the apparatus has a much longer cycle time between changes of the parts.

18 Claims, 5 Drawing Sheets

REFRACTORY MATERIAL COATED METAL SURFACES ADAPTED FOR CONTINUOUS MOLDING OF CONCRETE BLOCKS

BACKGROUND OF THE INVENTION (1) Field of the Invention

The present invention relates to an apparatus for continuous molding of concrete blocks having refractory material coated metal surfaces which mold the concrete blocks. In particular, the present invention relates to metal surfaces which have been flame sprayed with a mixture of a refractory material and a metal binder to provide abrasion resistance and then smoothed. Further, the present invention relates to a preferred polymeric coating of a thermoset polymer applied to the refractory and metal binder coating which provides a smooth surface for molding the concrete blocks.

(2) Description of Related Art

Examples of continuous concrete block molding apparatus are well known to those skilled in the art and are shown for instance by U.S. Pat. Nos. 2,319,291 to Besser, 2,587,413 to VanderHeyden, 2,566,787 to Zevely, 2,985,935 (Re. 25,404) to Wellnitz, 3,608,162 to Staton, 3,832,119 to Woelk, 3,660,004 to Woelk, 3,545,053 to Besser, 4,235,580 to Springs et al, 4,260,352 to Balhorn, 4,395,213 to Springs et al and 4,978,488 to Wallace.

The production rate of a block molding plant is a linear flow which is paced by the block apparatus. When the block molding apparatus is running, the whole plant runs. When it is at rest, the whole plant is at rest. A mold change sequence, being made for whatever reason, usually because of wear on the mold, idles the block molding apparatus and disrupts the flow of the entire block plant for about 35 minutes or longer.

The principal elements of a block plant are as follows: (1) hoppers, bins, and water lines to feed sand, aggregate, cement, and water to the mixture; (2) a mixer and material handling system to feed the cementitious materials to the block molding apparatus; (3) a block molding apparatus producing up to 1,620 blocks per hour; (4) a stacking system to collect and position the green block carried on steel pallets in racks; (5) shuttles to move racks into the kiln; (6) a kiln to cure the green block; (7) shuttles to remove racks from the kiln; (8) a device to remove the cured block and steel pallets from the racks; (9) a depalleter to remove the block from the steel pallets; and (10) a cuber to collect, bundle, and strap the individual blocks for shipment.

The principal components of concrete block (including paver) mold assembly in the block molding apparatus are preferably manufactured of 8620 steel and carburized (case hardened) to 48 to 52 Rockwell, C-scale. This case hardened surface resists both wear and abrasion while still providing a ductile core which allows parts to be straightened after physical part distortions occur in the heat treating process. Surfaces of division plates forming the blocks must be ground before heat treatment to a 125 pin or better micro finish to produce smooth finishes on the faces of the concrete blocks being formed.

A steel pallet (plate) is held against the bottom of the mold by hard rubber blocks. Voids in the mold cavity are filled with cementitious materials and the mold assembly is caused to vibrate by the spinning of eccentric weights located on each end of the mold assembly. The cementitious materials begin to compact under vibration and a plunger is lowered to help compress the materials against the steel pallet by adding additional physical forces to the compacting forces caused by the vibration. Once the proper material density has been reached, as measured by the amount of material fed into the mold assembly, the length of the cycle time, and the measured height of the block, the vibration ceases. The steel pallet and a plunger are then lowered, stripping the block from the bottom of the mold. The pallet carrying the finished block then shuttles out of the apparatus and a new pallet is placed in position and raised against the bottom of the mold assembly. The cycle is then repeated.

Mold assembly wear is caused by the forming, compaction, and stripping of highly abrasive cementitious materials and by metal parts sliding against one another during the cycle and parts coming together during vibration. The wear pattern typical for a concrete block mold assembly is usually about $8\frac{1}{2}''$ (22 cm) up the inside of the mold assembly. Thus, surface wear can occur by friction wherein the materials being vibrated and compacted abrade the surface of the mold or it can occur by impact erosion. In impact erosion, material is displaced from the surface of the mold by physical contact with other components of the mold assembly and the materials themselves being compacted in between components of the mold which are moving in opposite directions and at different rates of speed. This process continues until the surface condition of the mold assembly is unsuited for further use.

In an attempt to create satisfactory molds, solid, tungsten carbide plates, 90 to 100 mils thick, were cast and then bonded to flat surfaces of the mold, and more than a million cycles were completed with no appreciable wear. Coating thicknesses, the cost of the material, and the limitation of casting and applying the coating only on flat surfaces of the mold limited the usefulness of this solution to wear in the mold assembly.

Attempts have been made to increase the surface life of concrete-block molds by applying hard finishes; examples include flame spraying, plasma spraying, and hard chrome plate. Such expedients proved unsuccessful because of material porosity and limited surface adhesion. Other types of surface hardening treatments such as carburizing and nitrating are being used with varying degrees of success.

Udale, U.S. Pat. No. 1,536,952, and Sanborn, U.S. Pat. No. 4,571,983 show flame spray coating of steel working parts with refractory metal in order to increase the number of working cycles they can undergo. It should be noted that these patent disclosures deal with applications in which there is no direct physical contact between surfaces of the mold (e.g. relatively low forces are exerted between the respective surfaces). They disclose examples of materials being molded, pressed, formed, and sheared in dies designed with close fits and running tolerances. In the case of concrete-block apparatus, large mold assemblies and material masses moving in opposite directions and at different rates of speed are subject to abrasion and surface erosion through direct physical contact. This physical contact includes materials very hard in nature and deformation resistant which results in surface material being displaced and rapid erosion of the mold assembly.

Flame spraying of metal parts with metals, alloys and refractory materials to impart wear resistance is well known to those skilled in the art as represented by U.S.

Pat. Nos. 1,536,952 to Udale et al, 3,419,415 to Dittrich, 4,262,034 to Anderson, 4,420,543 to Kondo et al. U.S. Pat. No. 2,964,420 to Poorman et al describes the type of coatings which are useful in the present invention, including refractory materials and a binder metal. Such coatings have a high resistance to abrasion, although they tend to be rough and have to be smoothed. U.S. Pat. No. 4,571,983 to Sanborn et al describes a pressure method for smoothing such coatings. Tungsten carbide in a metal matrix is the most well known.

Flame spraying produces the most dense and preferred coating. This coating is described in Product Engineering 59 to 64 (Dec. 6, 1965). One type of equipment is produced by Metco Division of Perkin Elemer, Westbury, N.Y. and the method is described at pages 2.1 to 3.2 with Tables 1 to 7 and is a particularly preferred system.

Fluorocarbon coating materials are known to those skilled in the art. One such material are the Xylan® materials manufactured by Whitford Corporation, West Chester, PA. These materials are a mixture of an amide thermoset polymer and polymeric tetrafluoroethylene (PTFE). They are known to provide wear resistance. They are described in a Product Bulletin dated Sep. 4, 1990, particularly XYLAN® 1014/870 Black. U.S. Pat. No. 5,069,937 to Wall also describes the use of polymers containing PTFE for flame sprayed metal coatings to increase corrosion resistance with chromium coatings to provide hardness. The base material can be steel. There is no suggestion in the prior art that such coatings have any use in concrete block making apparatus where smoothness of the surface forming the mold assembly is important.

OBJECTS

It is therefore an object of the present invention to provide mold assemblies and parts of concrete block making apparatus with a coating, including a refractory material-binder combination, which resists wear by the concrete. Further, it is an object of the present invention to provide replaceable parts of such apparatus with the coating. Further still, it is an object of the present invention to provide coated mold parts which are economical to produce. Further, it is an object of the present invention to provide an apparatus with significantly less down time for replacement of mold parts which are worn out because of longer life. Finally, it is an object of the present invention to provide blocks which can be produced economically to the highest standards. These and other objects will become increasingly apparent by reference to the following description and the drawings.

DESCRIPTION OF PREFERRED EMBODIMENTS

Figure 1:
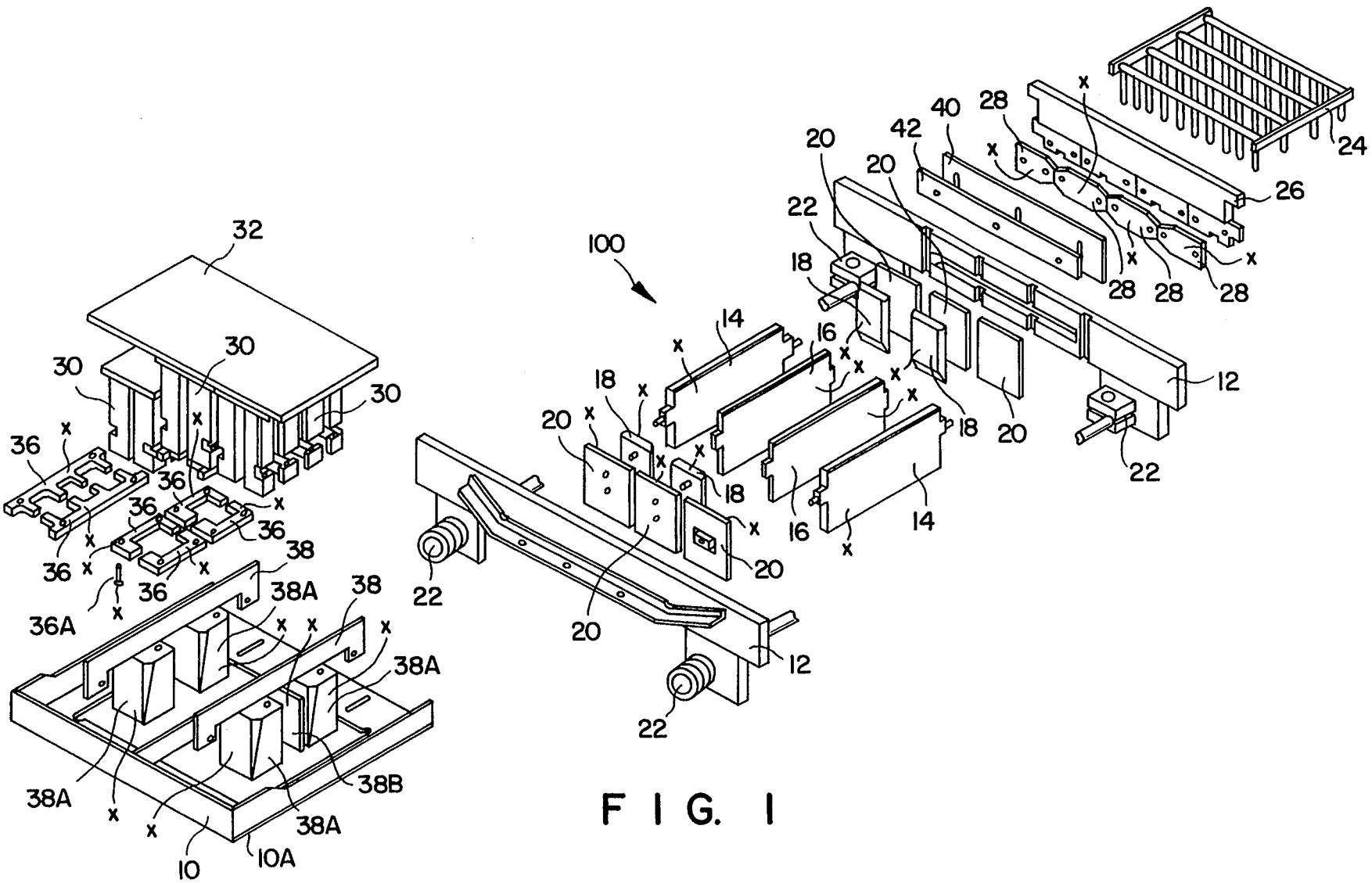
FIG. 1 is a separated perspective view of the inner parts of a concrete block molding apparatus showing the parts of the apparatus which are coated with the refractory material and metal binder. The coated parts are shown with a lead line to an "X".
Figure 2:
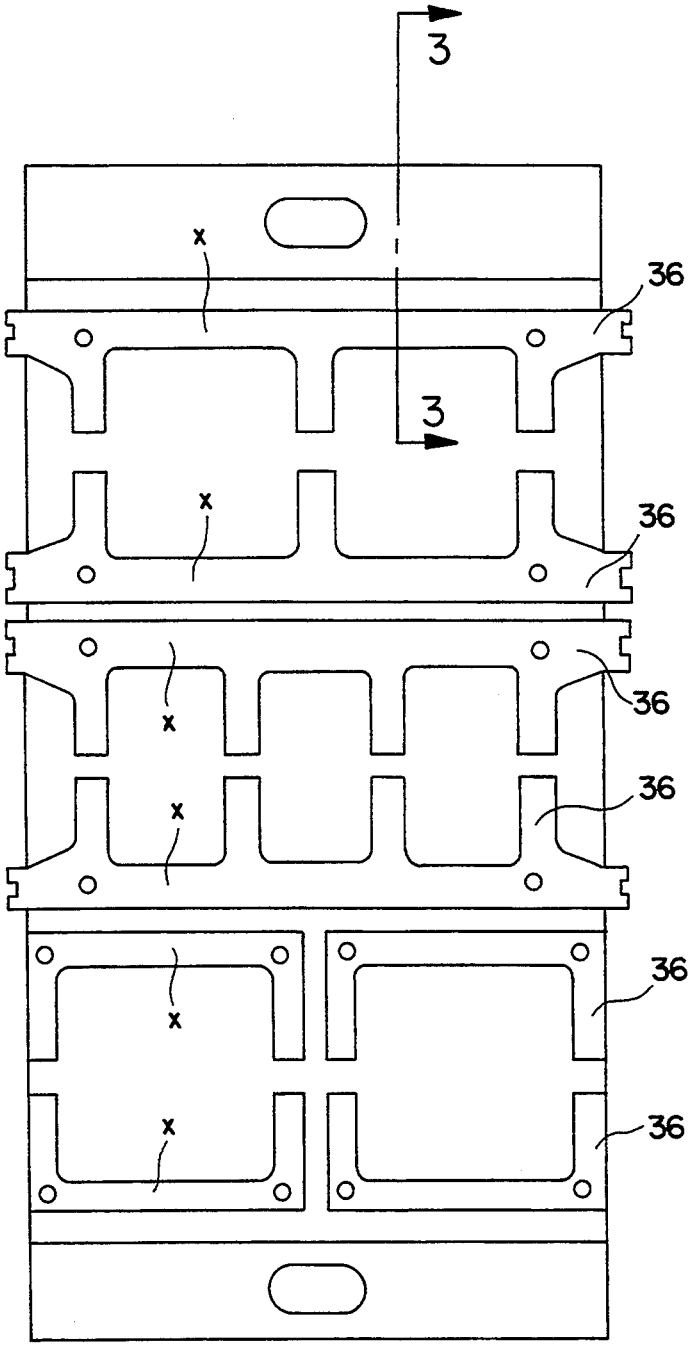
FIG. 2 is a bottom view showing the faces of stripper shoes 36 used to compress cement in the mold assembly 100 of FIG. 1 and to strip the formed block from the mold assembly 100.
Figure 3:
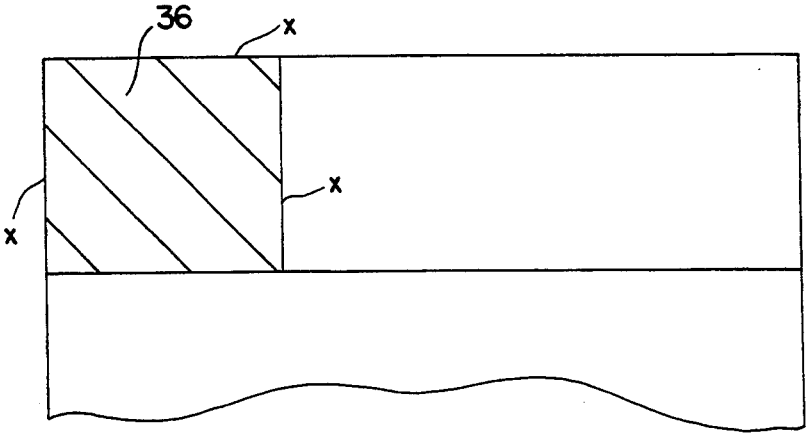
FIG. 3 is a cross-sectional view along line 3—3 of FIG. 2 which shows faces of stripper shoes 36 used to compress cement in the mold and to strip the formed block from the mold. The face of the stripper shoe 36 and the leading edges of all sides (X) are coated with the refractory materials and metal binder.
Figure 4:
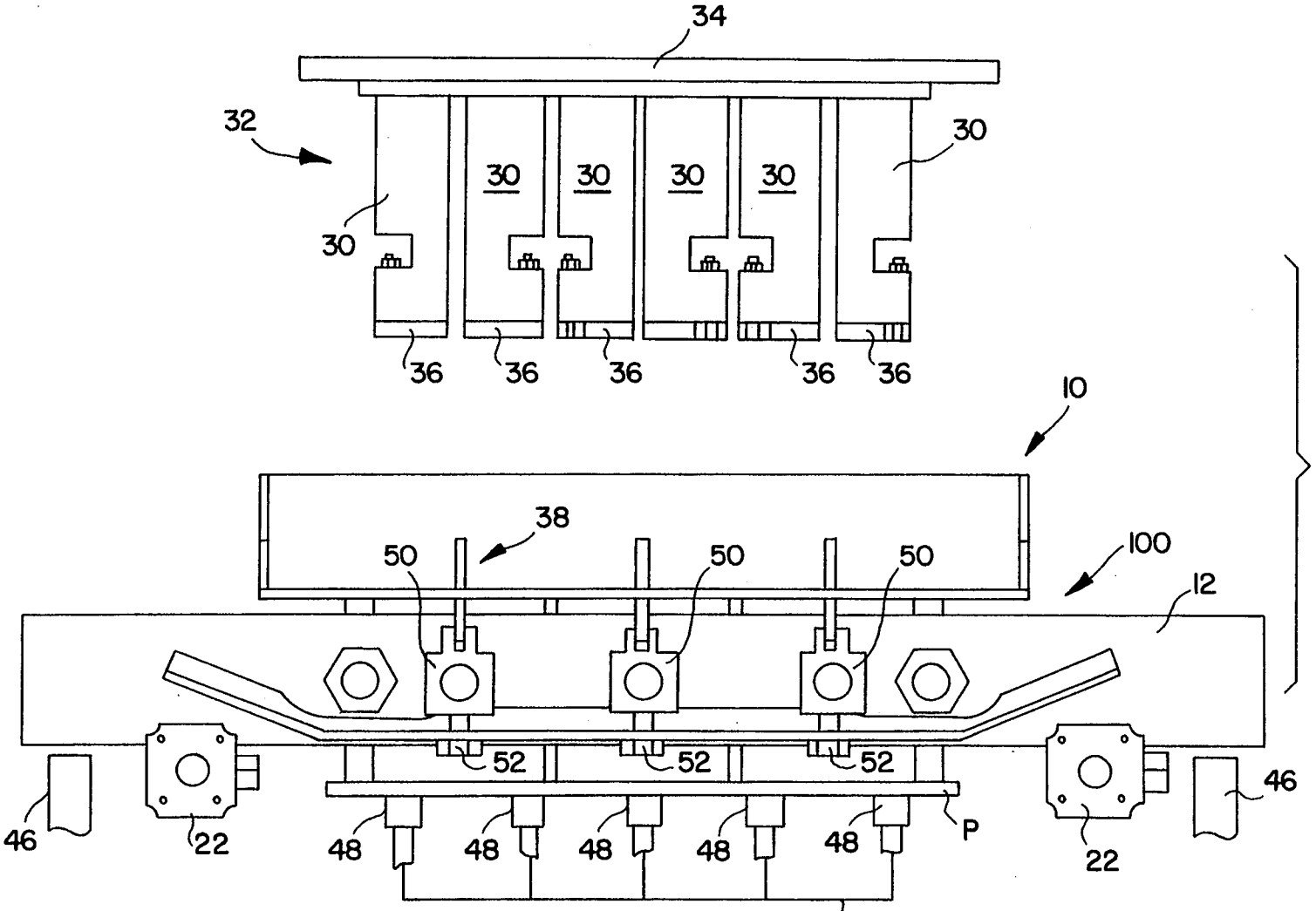
FIG. 4 is a side view of mold assembly 100 of FIG. 1 with plunger assembly 32 positioned above the mold assembly 100 ready to be lowered and compress the cementitious materials. The pallet receiver frame 44 has been raised, raising the mold off the mold carrier pins 46, and ready to start the mold cycle. Eccentric weights on the mold vibrator assembly 22 start spinning and the hard rubber "pucks" 48 on the pallet receiver frame 44 cause the mold assembly 100 to vibrate in a vertical direction.
Figure 5:
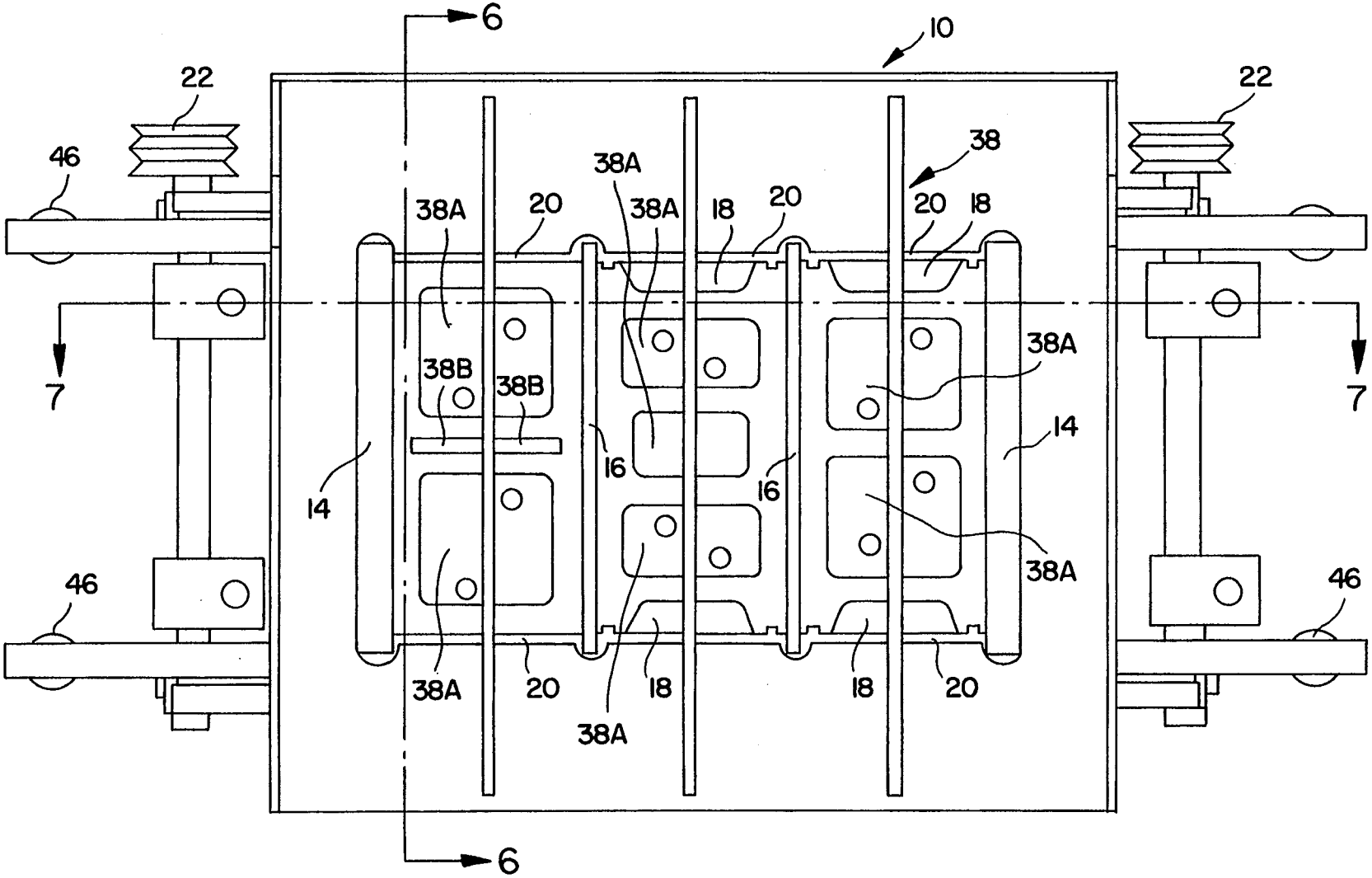
FIG. 5 is a top view illustrating the use of cores 38A and core plates 38B inside the mold assembly 100 and illustrates outside and inside division plates 14 and 16, end liners 20, and end cores 18 to contain the cementitious materials and define the mold assembly 100. All mold assembly 100 surfaces used in forming the block are coated with refractory materials.
Figure 6:
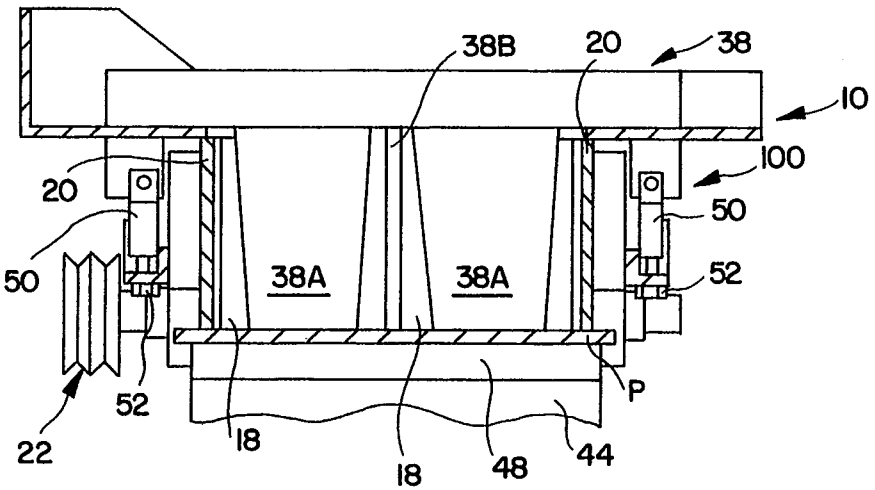
FIG. 6 is a cross-sectional view along lines A—A of FIG. 5
Figure 7:
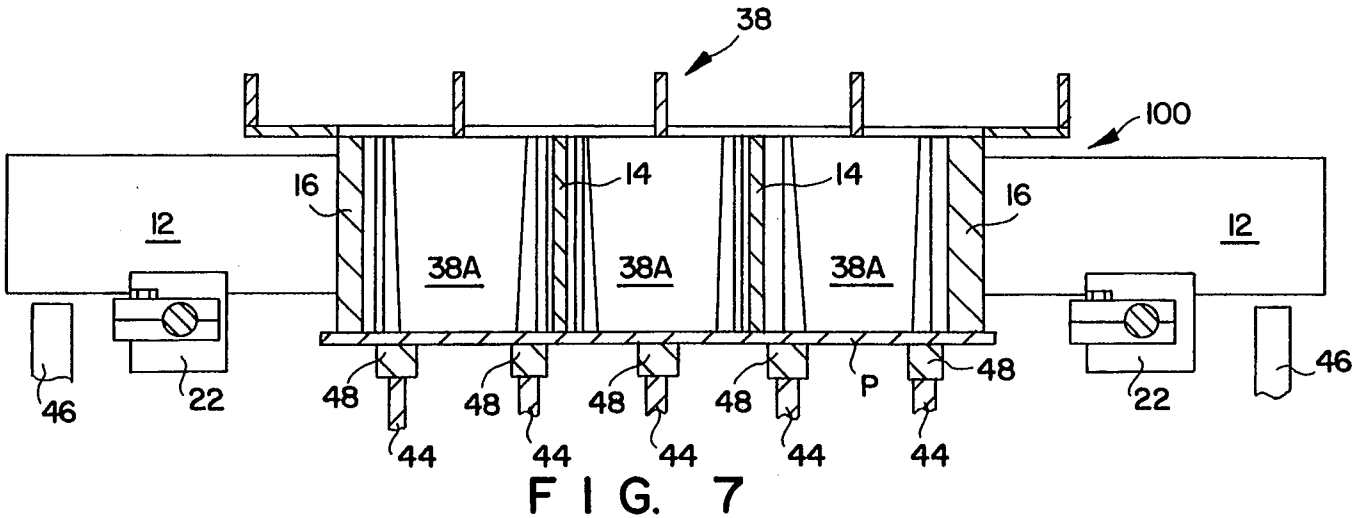
FIG. 7 is a cross sectional view along line B—B of FIG. 5 which illustrates use of cores 38A and core plates 38B, and end liners 20 inside the mold assembly 100. Also illustrated are the outside and inside division plates 14 and 16, end cores 18 and end liners 20, to contain the cementitious material and define the mold assembly 100. All mold assembly 100 surfaces used in forming the block are coated with refractory materials.

The present invention relates to an apparatus for continuous molding of concrete blocks with parts which mold the block and which remove the block from the mold, the improvement which comprises providing on metal wear surfaces of at least some of the parts of the apparatus which come into contact with the blocks or which come into contact with each other during the molding with a smooth coating, which comprises a flame sprayed metal refractory material admixed with a binder.

The present invention also relates to a concrete block molding apparatus of the kind having a frame, a vibratable open bottom mold supported on and in contact with the frame, a pallet support beneath the mold, a pallet carried on the pallet support, motion transmission means connected to the pallet support for raising the pallet toward the mold a distance sufficient to seat the pallet against the bottom of the mold, vibration means for vibrating the mold and a stripper head for removing the block from the mold by pushing the block towards the pallet, the improvement which comprises: metal wear surfaces of the mold and stripper head which come in contact with the block and which come into contact with other parts of the apparatus during the molding with a smooth coating which comprises a flame sprayed metal refractory material and a binder wherein the refractory material coating has a thickness between about 0.05 and 30 mils.

Further, the present invention relates to a part for a concrete block molding apparatus selected from the group consisting of an end core, an end core liner and inside and outside division plates; a stripper shoe on a plunger for pushing the blocks and a core with a coating on surfaces of the parts for making concrete blocks which come into contact with the concrete blocks as the blocks are formed in the apparatus or which come into contact with other of the parts during the molding, wherein the coating comprises a flame sprayed metal refractory material and a binder.

Finally, the present invention relates to a metal wear surface which comprises a metal base surface, a flame spray coated refractory material admixed with a binder adhered on the base surface; and a polymer coating of polytetrafluoroethylene admixed with a polymeric binder adhered to the refractory material, wherein the refractory material has a thickness between about 0.05 and 30 mils and wherein the polymer coating coats the refractory material.

The term "concrete block" means any shape which is molded, including building blocks, landscaping blocks, and so-called "paver stones" used as patio stones, for instance.

The term "mold assembly" as used herein, means any part of the concrete molding apparatus which comes into contact with the concrete block.

The term "thermoset polymer" means any polymer which upon curing forms a resin which does not soften or melt upon heating. Such polymers are epoxy, amide, phenolics, polysulfones such as described in Great Britain Application 2,113,235A. Such polymers are described for instance in Polymers and Resins by Goulding, D. VanNostrand, Princeton, N.J., pages 116 and 117 (1959) and many later publications.

The term "refractory material" means any compound of carbon, nitrogen, boron, oxygen, silicon and other Group IIIA, IVA, VA and VIA elements in the second and third periods of the Periodic Table which form refractory materials, which preferably have a hardness greater than about 300 Diamond Pyramid hardness number with a 300 gram load and a melting point of greater than about 2370° F. (704° C.) as described by Poorman et al (U.S. Pat. No. 2,964,420) discussed previously.

The term "binder" means any metal which can serve as a matrix for the refractory material in forming the coating. Most preferred are the Group IVB, VB, VIB, VIIB and VIIIB metals in the 4th period, as well as molybdenum in the 5th period of the Periodic Table.

The term "polytetrafluoroethylene" means any polymer of tetrafluoroethylene which provides ease of slippage of the concrete blocks as they are formed in the mold.

The term "flame sprayed" means any method by which refractory materials and a metal binder are heated and sprayed onto a surface to provide an adherent coating. Included are detonation spraying, plasma spraying, high velocity spraying and the like.

The present invention is directed to improving the life of concrete-block mold assemblies using a surface treatment. Such mold assemblies have predetermined contours and are used to form cementitious materials to the mirror image contour. The surface treatment consists of flame spraying a thin layer of a refractory material. Such refractory binder combinations are for instance:

(1) Carbides—Tungsten carbide (WC) with a cobalt binder, with a nickel binder, with an iron-nickel binder, with a copper/aluminum/chromium binder, with a chromium-molybdenum binder, with a chromium binder, with a silver binder; titanium carbide (TiC) with a cobalt or with a nickel binder; boron carbide ($B_4C$) with an iron binder, a nickel and a ferro-chromium binder; chromium carbide ($Cr_3C_3$) with a cobalt or with a nickel binder; tantalum carbide (TaC) with a cobalt binder.

(2) Borides—Titanium boride ($TiB_2$) with an iron and a cobalt-tantalum binder; chromium boride ($CrB_3$) with a iron binder.

(3) Nitrides—titanium nitride (TIN) with a copper, cobalt, and nickel binder.

(4) Oxides—aluminum oxide with a nickel binder, a chromium binder.

(5) Mixtures and alloys—Tungsten carbide and titanium carbide alloy with a cobalt binder; titanium carbide and tantalum carbide alloy with a cobalt binder; chromium, molybdenum, and tantalum oxide; chromium, tungsten, and tantalum oxide; chromium boride and titanium boride with a nickel binder; tungsten carbide, chromium, molybdenum, and tantalum oxide; tungsten carbide and titanium boride with cobalt binder; tantalum carbide and boron carbide; zirconium dioxide and titanium carbide; tungsten and molybdenum; and tungsten and silicon with a nickel binder.

Flame spraying is required to generate the high deposition densities and bond strengths required to increase mold life. Flame sprayed, refractory materials greatly increase the wear and abrasion resistance of the mold. However, flame sprayed materials leave a very porous surface, unacceptable to the face of a concrete block and the surface of the mold.

Heat treated steels must be used for toughness in the mold assembly. Metal plates distort during the heat treating process. Thus the flame sprayed, refractory materials must be applied after heat treatment. Subsequent grinding, lapping, and other finishing techniques are not easily used to finish mold assembly surfaces because very limited amounts of expensive refractory materials are applied, the high cost of finishing these very hard surfaces, and the already physically distorted mold surfaces.

This invention preferably includes the use of tough, heat-treated steels in combination with high density, flame sprayed, refractory material coatings which greatly increase the life of the mold assemblies and a lubricating thermoset resin coating which conforms to the contours of the mold, fills in the pores and wears smoothly, thus producing a smooth finish on the face of the block, improving stripping of the block from the mold assembly, and helping protect the mold assembly surfaces from corrosion.

The refractory coating with the binder is preferably applied to steel molds made of various steels such as 8620 high carbon steel heat treated to a heavy case depth. It will be observed however, that the treatment can be applied to a wide variety of other steels and indeed to other mold assembly materials, including for example nickel alloys. The refractory material is preferably applied to the surface of the molds by flame spraying, using conventional techniques, for example a Metco Type DJ DIAMOND Jet Gun, (HVOF, high velocity oxygen fuel), operated at 150 psi oxygen, 100 psi propane, 125 psi nitrogen, 75 psi air, and 38 grams per minute of refractory material to apply the coating to the mold surface. The coating thickness need be only from 5 to 7 mils, but may be greater for reasons to be described below.

The coatings of the invention preferably comprises at least 60% to 93% by weight tungsten carbide or other refractory material. High density, flame sprayed, refractory materials with bond strengths greater than 14,000 psi and porosities of less than 0.5% can be obtained. Individual powder particles can contain both larger and fine crystalline structures. Mold life increased from eighty thousand to more than six-hundred thousand cycles in one application.

The economic significance of this improvement can be appreciated in that several hundred man hours were required to manufacture, change over, and maintain block mold apparatus. The process of the invention requires time to apply and adds material cost, but it provides great improvement in mold life.

Within the concrete-block mold assembly, certain portions of the molds parts are observed to wear at much greater rates than other portions. In such a case, a substantially thicker layer of flame sprayed coatings can be locally applied to high wear areas. This technique increases the life of the locally treated mold assembly region.

The primary benefit of the present invention is increased mold assembly life. However, it is also observed that worn mold assembly parts can be repaired by applying an excessive build-up of coating materials on the surfaces of the mold part which have become worn, reducing replacement part fabrication time and cost and improvement in mold assembly turn around time.

FIG. 1 shows a separated view of a typical concrete molding machine, such as manufactured by Besser Company, Alpena, Michigan. The mold is formed by the top mold plate 10 which includes horizontal plate 10A which closes the top of the mold assembly 100. The mold assembly 100 sides are formed by mold side bars 12 which are held together by outside division plates 14 and inside division plates 16 and which support end cores 18 mounted on end liners 20. Vibrator shaft assemblies 22 serve to vibrate the mold as the blocks are formed. An agitator grid 24 is used to agitate the concrete which is in the mold assembly 100. A cutoff bar 26 with cutoff shoes 28 mounted thereon is used to smooth the surface of the concrete after it has been poured into the mold assembly 100. Plungers 30 in plunger assembly 32 supported by head plate 34 are provided mounting stripper shoes 36, which are held in place by pins 34A, to compact and strip the blocks after they are formed. The downward faces and sides of the shoes 36 are coated with the refractory material binder. Core assemblies 38 with cores 38A and optionally core plate 38B are provided to mold the openings in the concrete blocks. Stripper head wiper rubber 40 and frame 42 are provided to protect the stripper shoes 34. Outside division plates 14 and inside division plates 16 are mounted between the mold side bars 12 to provide the separate cavities for each block formed with the core assemblies 38, and top plate 10. A flat platen P forms the bottom of the mold assembly 100. A pallet receiver frame 44 transports the pallet P. Carrier pins 46 support the mold assembly 100. Rubber "pucks" 48 on the pallet receiver 44 with the vibrating shaft assemblies 22 vibrate the mold assembly 100 to compact the fluid concrete. Hold down blocks 50 and bolts 52 secure the core assembly 38 in position in the mold assembly 100.

Industry mold wear parts for concrete blocks particularly include outside and inside division plates 14 and 16, end cores 18, stripper shoes 36, end liners 20, stripper shoe retention pins 36A, cores 38A and core plates 38B. The parts and assembly represented in FIG. 1 are typical of the molds being used throughout the concrete products industry.

In applying flame sprayed coatings, coating material, in powder form, is fed into a high velocity oxygen/fuel gas combustion flame. Powdered particles are partially melted by the flame and projected by the gas stream onto the prepared surface of the mold part or component to which they tightly adhere forming the desired coating.

Unlike other spray welding and coating processes, the high velocity flame spraying process produces the high coating material densities and bond strengths necessary to create a strong and abrasion resistant surface, greatly extending the useful lives of the block mold assemblies used in the concrete products industry. Coating thicknesses and locations can be controlled to maintain proper component fits and alignments; yet, provide effective, economical, and highly abrasion and wear resistant coatings.

Elements of the high velocity spray process include a oxygen or other fuel propellent mixture, combustion chamber, ignition, and combustion flame to which powdered coating materials are added. Flame temperatures and gas velocities typical of this process are 5,000° F. and 4,500 ft./sec.

Conventional heat treated steel mold assembly parts provide a useful mold life of 80,000 to 120,000 cycles. The high velocity spray coatings of the present invention provide many times this useful life depending on the materials being used and the applied thicknesses of the coatings.

The use of high velocity spray coatings applied to mild steel or some other soft metallic substrate for parts of the molding apparatus which contact each other or which come into contact with the concrete can replace heat treated steels and can extend the mold life throughout the concrete products industry.

EXAMPLE 1

Case hardened, inside division plate 16, was high-velocity sprayed on both faces with 3 to 6 mills METCO DIAMALLOY 2004 which contains tungsten carbide as the refractory material with cobalt as the binder. The plate 16 was installed in a mold assembly 100 in a BESSER TM Block Machine. The mold assembly 100 operated for 6,250 cycles with no appreciable wear. The blocks produced had a rough surface. The coated surface of plate 16 was porous. High porosity was noted on the face of the concrete blocks produced by the mold inside division plate 16 when the face of each block was painted. No appreciable wear was detected upon examination of the plates 16 when removed from the machine.

EXAMPLE 2

Soft steel, inside division plate 16, was coated as in Example 1 and finish ground to a total thickness tolerance of one (1) mill. The plate 16 was high-velocity sprayed on both faces with 8 to 12 mills of DIAMALLOY 2004. The finish on the faces was ground with a diamond wheel to better than a 60 micro finish with a 3 to 6 mills remaining coating thickness. The plate 16 was installed in a mold assembly 100 in a BESSER TM Block Machine. The blocks did not strip as well from the DIAMALLOY 2004 ground surface as when uncoated surfaces in the mold assembly and caused surface imperfections. The plate 16 was removed from the mold assembly 100 and no appreciable wear was detected.

EXAMPLE 3

Soft steel, inside division plates 16 was finish ground to total thickness of one (1) mill. The plates 16 were high velocity sprayed on both faces with DIAMALLOY 2005. There was a 160 percent higher tungsten carbide in the coating. The plates 16 were finish ground with a diamond wheel to better than a 60 micro finish with 3 to 6 mills of remaining coating thickness. No benefit was achieved by using more tungsten carbide.

EXAMPLE 4

Soft steel, full set inside and outside division plates 14 and 16, were finish ground to total tolerance thickness of one (1) mill. The plates 14 and 16 were high-velocity sprayed on faces with 8 to 12 mills DIAMALLOY 2004. The plates 14 and 16 were finish ground with a diamond wheel to better than a 60 micro finish and 3 to 6 mills of remaining coating thickness. The plates 14 and 16 were installed in a mold assembly 100 in a Besser TM Block Machine equipped with mold assembly pin 46 alignment. The machine ran for 80,000 cycles with no appreciable wear of the plates 14 and 16. The plates 14 and 16 are still in production.

EXAMPLE 5

Case hardened, high velocity sprayed, set of inside and outside division plates 14 and 16 with mold faces sprayed with only 3 to 6 mills DIAMALLOY 2004. All sprayed surfaces of the plates 14 and 16 were coated with 2 to 4 mills of Whitford (West Chester, PA) XYLAN 1014/870 Black, a thermoset amide resin containing polytetrafluoroethylene and cured for 30 to 60 minutes at 375° F. The plates 14 and 16 were installed in a mold assembly 100 in a BESSER TM Block Machine. The blocks stripped cleanly from the machine and had uniformly smooth block faces. The faces of the division plates 14 and 16 were worn to a smooth, even finish with the resin binder filling the pores in the refractory material.

In tests it appears that based upon a projection of the wear for mold parts presently in service that the mold can last over a period of about 500,000 to 1,000,000 cycles. This represents 5 to 10 times increase over conventional hardened steel mold parts.

It is intended that the foregoing description be only illustrative of the present invention and that the present invention be limited only by the hereinafter appended claims.

I claim:

1. In an apparatus for continuous molding of concrete blocks of the kind having a frame, a vibratable open bottom mold supported on and in contact with the frame, a pallet support beneath the mold, a pallet carried on the pallet support, motion transmission means connected to the pallet support for raising the pallet toward the mold a distance sufficient to seat the pallet against the bottom of the mold, vibration means for vibrating the mold and a stripper head for removing the block from the mold by pushing the block towards the pallet, the improvement which comprises providing metal wear surfaces of at least some of the parts of the apparatus which come into contact with the blocks or which come into contact with each other during the molding with a coating, which comprises a flame sprayed metal refractory material admixed with a binder and covered with a polymer.

2. The apparatus of claim 1 wherein the polymer is a thermoset polymer so as to provide the coating.

3. The apparatus of claim 1 wherein the polymer is polytetrafluoroethylene (PTFE) in a polymeric binder so as to provide the coating.

4. The apparatus of claim 3 wherein the polymeric binder is a polyamide polymer.

5. The apparatus of claim 1 wherein the refractory material has a hardness of between about 300 and 1200 Diamond Pyramid Hardness Number when tested with a 300 gram load and the coating has a thickness between about 0.5 and 60 mils.

6. The apparatus of claim 1 wherein the refractory material is tungsten carbide.

7. The apparatus of claim 1 wherein the refractory material is tungsten carbide and the binder comprises cobalt.

8. The apparatus of claim 7 wherein the binder is a cobalt and nickel.

9. In a concrete block molding apparatus of the kind having a frame, a vibratable open bottom mold supported on and in contact with the frame, a pallet support beneath the mold, a pallet carried on the pallet support, motion transmission means connected to the pallet support for raising the pallet toward the mold a distance sufficient to seat the pallet against the bottom of the mold, vibration means for vibrating the mold and a stripper head for removing the block from the mold by pushing the block towards the pallet, the improvement which comprises: providing metal wear surfaces of the mold and stripper head which come in contact with the block and which come into contact with other parts of the apparatus during the molding with a coating which comprises a flame sprayed metal refractory material and a binder covered with a polymer wherein the refractory material coating has a thickness between about 0.05 and 30 mils.

10. The apparatus of claim 9 wherein the polymer is a thermoset polymer so as to provide the coating.

11. The apparatus of claim 9 wherein the polymer is polytetrafluoroethylene (PTFE) in a polymeric binder so as to provide the coating.

12. The apparatus of claim 9 wherein the polymeric binder is a polyamide polymer.

13. The apparatus of claim 9 wherein the refractory material has a hardness of between about 300 and 1200 Diamond Pyramid Hardness Number when tested with a 300 gram load and the coating has a thickness between about 0.5 and 60 mils.

14. The apparatus of claim 9 wherein the refractory material is tungsten carbide.

15. The apparatus of claim 9 wherein the refractory material is tungsten carbide and the metal binder comprises cobalt.

16. The apparatus of claim 9 wherein the binder is a cobalt and a thermoset resin.

17. The apparatus of any one of claims 1 and 9 wherein the flame sprayed surface is detonation flame sprayed.

18. The apparatus of claim 1 wherein the binder is an epoxy resin.

* * * * *